United States Patent [19]

Umezawa

[11] Patent Number: 5,067,306

[45] Date of Patent: Nov. 26, 1991

[54] PROCESS AND APPARATUS FOR PROCESSING EASY-OPENING BAG

[75] Inventor: Kazumi Umezawa, Tokyo, Japan

[73] Assignee: Asahi Chemical Polyflex Co., Ltd., Tokyo, Japan

[21] Appl. No.: 531,996

[22] Filed: Jun. 1, 1990

[30] Foreign Application Priority Data

Jun. 2, 1989 [JP] Japan ..... 1-139075

[51] Int. Cl.[5] ..... B65B 61/18

[52] U.S. Cl. ..... 53/412; 53/451; 53/133.8; 53/551; 53/389.3; 53/389.4; 83/660

[58] Field of Search ..... 53/133, 141, 389, 412, 53/450, 451, 477, 550, 551, 552, 133.8, 389.3, 389.4; 83/660, 677, 678, 886; 156/250, 251, 252, 257; 383/100, 101, 103, 109; 493/363, 364, 365, 930, 963

[56] References Cited

U.S. PATENT DOCUMENTS

| | | | |
|---|---|---|---|
| 3,021,732 | 2/1962 | Schur | 83/660 X |
| 3,083,876 | 4/1963 | Schneider et al. | 53/133 |
| 3,212,381 | 10/1965 | Heyer | 83/678 X |
| 3,390,507 | 7/1968 | Repko | 53/412 |
| 3,399,760 | 9/1968 | Hechler | 206/65 |
| 3,642,126 | 2/1972 | Kurtz et al. | 206/6.3 |
| 4,543,279 | 9/1985 | Kai | 428/35 |
| 4,567,986 | 2/1986 | Eastwood | 206/532 |
| 4,778,058 | 10/1988 | Yamazaki et al. | 206/610 |
| 4,919,272 | 4/1990 | Kai et al. | 206/610 X |

*Primary Examiner*—John Sipos

*Attorney, Agent, or Firm*—Jordan and Hamburg

[57] ABSTRACT

A process for providing easy-opening of a sealed and packed bag by means of an automatic bag-making packer involves pressing on a side margin of an outermost turn of a roll of film a cylindrical surface of a cutting roller mounted in the automatic bag-making packer, the cylindrical surface of the cutting roller having multiple edged projections for forming microcuts in the side margin, so that a resulting sealed and packed bag is easily opened from a side margin of the sealed and packed bag without reducing the mechanical strength of a film constituting the sealed and packed bag. An automatic bag-making packer embodying the process includes a cutting roller, an outer cylindrical surface of which has edged projections, the cutting roller being in close contact with a point on a top surface of an outermost turn of a roll of film mounted on a hollow cylindrical roll core made of paper, the cutting roller rotating and pressing on a side margin of the outermost turn as the film is fed from the roll of film, and a positioning roller adjacent the cutting roller to prevent transverse movement of the roll of film while the cutting roller presses on the side margin of the outermost turn thereof.

20 Claims, 3 Drawing Sheets

PROCESS AND APPARATUS FOR PROCESSING EASY-OPENING BAG

BACKGROUND OF THE INVENTION

1. Field of the Invention

The present invention relates to a process and apparatus which in producing a sealed and packed bag, can process a bag for hand opening without reducing the mechanical strength of the bag until a user opens the bag. It relates more particularly to a process for processing an easy-opening and automatic bag-making packer employing an ordinary bag-making film and processing an easy-opening on the film when the film is fed from a roll of film.

2. Description of the Related Art

Conventionally, since a plastic bag made of polyethylene, polypropylene, polyester or nylon has advantages in that the bag can employ a film made thereof as a material for the bag, has good sealing performance, mechanical strength, printability and transparency and promotes efficiency by concurrently providing bag-making by heat seal and bag-packing, such a bag has been widely used in packing various products, e.g., liquid, powder, paste, solid or discrete products. However, long-term preservation of the contents in the bag has required use of a high-strength film, so that the bag must be cut and opened with a cutter.

Generally, the bag has a high mechanical strength but a low tear propagation strength, so that once the bag experiences an unintentional crack, a tear tends to easily propagate from the crack in an unintended direction. In order to improve the operability of a sealed bag, a heat sealed margin of the sealed bag has been provided with and I- or V-shaped notch extending toward the body of the bag. Thus, hand-pulling the heat sealed margin of the bag at the I- or V-shaped notch along the axis of the notch can provide an easy propagation of tear from the notch in an intended direction in the bag, even when made of plastic film of a high mechanical strength.

In addition, U.S. Pat. No. 4,543,279, for example, disclosed a prior art which provided a large number of microcuts which would not themselves reduce the mechanical strength of the bag and were arranged closely to one another along an edge of the heat sealed margin of a sealed bag. In detail, the opposite side margins of a blank film with a size and shape corresponding to those of a desired sealed bag first are provided with microcuts passing through each blank film, after which the blank film is rolled up on a hollow cylindrical roll core made of paper so that the microcuts in one side margin of the blank film will not overlap those in the other side margin of the blank film, and then the roll of film is mounted in an automatic bag-making packer. A means for providing the microcuts comprises a pair of pinch rollers feeding a blank film from a roll of film. One of the pinch rollers, a cutting roller, is made of a hard material and has a large number of edged projections. The other of the pinch rollers, a receiving roller, is made of a material, e.g. rubber, of a surface hardness providing a hardness supporting the cutting roller to form the microcuts in the blank film and also a softness protecting the edged projections from quick wear. Since the edged projections of the cutting roller pass through each side margin of the blank film to penetrate the receiving roller, the receiving roller is quickly worn without a surface cover thereon. Actually, in order to minimize this wear in the receiving roller, a gummed plastic-sheet tape has been attached around the receiving roller. The position of attachment of the tape must be changed two or three times a day during operation of the microcuts-providing means, or the tape must be exchanged in order to reduce wear in the receiving roller.

Thus, the first and second prior-art processes described above require high accurate positioning of a notch or microcuts in the blank film in order to produce a complete sealed and packed bag. In addition, apparatuses for the first and second prior-art processes also require a high accurate positioning of the notch or microcuts.

Thus, an automatic bag-making packer including a microcut former or notch former will produce a sealed and packed bag with an easy-opening processing from an ordinary plastic film.

The present inventors have studied such a machine from various viewpoints. A roll of film mounted in an automatic bag-making packer cannot be free from transverse rocking in feeding the film. Transverse rocking of the roll of film will constitute no problem on an automatic bag-making packer without a microcut or notch former but will fail to provide adequate accuracy in positioning microcuts or a notch by means of an automatic bag-making packer with a microcut or notch former providing microcuts or a notch or film which has been dispensed from the roll of film. In addition, since reducing the size of an automatic bag-making packer has been generally promoted and the automatic bag-making packer has been designed to operate adequately in as small a space as possible, securing a space in the automatic bag-making packer for stably receiving pinch rollers comprising a cutting roller and a mating or receiving roller is difficult. Even if the automatic bag-making packer can secure this space, the packer must increase in size and be more complicated in structure.

SUMMARY OF THE INVENTION

An object of the present invention is to provide a process for processing an easy-opening on a sealed and packed bag and an apparatus embodying this process. The process of the present invention is a process of producing a sealed and packed bag by means of an automatic bag-making packer, the process comprising the step of pressing on a side margin of an outermost turn of a roll of film, and mounted in the automatic bag making packer, the cylindrical surface of a cutting roller having multiple edged projections for forming microcuts in the side margin so that a resulting sealed and packed bag is easily opened from a side margin of the sealed and packed bag without reducing the mechanical strength of the film constituting the sealed and packed bag.

In accordance with one preferred embodiment of the present invention, a pair of positioning rollers is positioned at a pair of opposite points around the outermost turn of the roll of film and mounted on and spaced with an inner breadth equalling the breadth of the film of the roll of film along a shaft in parallel to a hollow cylindrical roll core made of paper and having thereon the roll of film; a pair of cutting rollers each having an outer cylindrical surface with edged projections and each having a diameter smaller than the corresponding diameter of the positioning rollers are each attached to an interior edge surface of a corresponding one of the positioning rollers so as to be arranged coaxially with the corresponding positioning roller, the outer cylindrical surface of each of the cutting rollers pressing on the outermost turn of the roll of film; opposite ends of a shaft external of the positioning rollers have a shaft support plate; and the shaft support plate has a means for descending the shaft as an outer diameter of the roll of film decreases so that the cutting rollers continue to press on the opposite side margins of the outermost turn of the roll of film.

Films used in the present invention comprise soft plastic films made, e.g., of polyethylene, polypropylene, polyester, polyvinylchloride, polyvinylidenechloride and nylon. These films may be a single-layer film, a multilayer film made with a heat-sealable layer such as low density polyethylene or ethylene-vinyl acetate copolymer, and a non-heat-sealable layer such as high density polyethylene, polypropylene, polyester, nylon or polyvinylidenchloride, or a multilayer film further comprising a layer made of any other material, e.g., a paper sheet or aluminum foil.

An automatic bag-making packer used in the present invention may be a packer comprising a film feeder feeding a film from a roll of film; an axial heat sealer axially heat sealing the film fed by the film feeder so as to define the breadth of a bag and produce a tubular film for the bag; a transverse heat sealer heat sealing a top margin of a preceding bag which has been packed with contents, the preceding bag having a bottom margin heat sealed by the transverse heat sealer and an open top margin, the transverse heat sealer concurrently heat sealing a bottom margin of a tubular film for a next bag; a means for packing contents in the preceding bag; and a transverse cutter separating the preceding and next bags between the heat sealed top margin of the preceding bag and the heat sealed bottom margin of the next bag concurrently with or immediately after the operation of the transverse heat sealer.

Generally, an automatic bag-making packer is classified into a vertical-type dropping the contents into a bag and a horizontal-type horizontally feeding the contents into a bag. Either of the two types of the automatic bag-making packer which feeds a film from a roll of film may embody the present invention.

An automatic bag-making packer of the present invention includes an easy-opening processor in the film feeder. The easy-opening processor comprises a rotatable shaft extending along the outer cylindrical surface of a roll of film mounted on an elongated hollow cylindrical roll core made of paper, the rotatable shaft extending in parallel to the roll core and being vertically movable. The rotatable shaft has a pair of positioning rollers mounted thereon, the spacing therebetween equalling the breadth of the film. The inner edge surface of either of the positioning rollers has a cutting roller attached thereto. The overall outer cylindrical surface of the cutting roller has a large number of edged projections for forming microcuts in the opposite side margins of the film.

Alternatively, a fixed shaft may replace the rotatable shaft, and pairs of positioning rollers and cutting rollers may be mounted to the fixed shaft by means of bearings so as to rotate independently of one another.

An automatic bag-making packer of the present invention may comprise a single cutting roller mounted to the shaft when the mechanical strength of a film is small. However, it preferably comprises a pair of cutting rollers mounted to the opposite ends of the shaft in the balance of the overall arrangement of the packer. The positions of these opposite ends of the shaft correspond to the axial heat sealed margins of the film. A final bag product has an axial heat sealed margin with microcuts not passing through the axial heat sealed margin.

In addition, when an automatic bag-making packer of axially separates a film which has been fed from the roll of film into at least two streams of film and makes and packs bags with contents concurrently between the streams of film, it provides a corresponding number of cutting rollers positioned intermediate the outermost side edges of the streams of film.

In addition, when an automatic bag-making packer of the present invention forms microcuts on the transverse heat sealed margin of the bag, it comprises a single cutting roller with a length equalling the breadth of the film and the circumference of the cross-section equalling the length of the bag. A single axial line on the outer cylindrical surface of this cutting roller has edged projections forming microcuts in the transverse heat sealed margin of the bag.

The shaft having the cutting rollers and positioning rollers passes through the center of each of the cutting rollers and positioning rollers. A diameter of each of the positioning rollers exceeds that of a corresponding one of the cutting rollers. Thus, a free area, i.e., an outer periphery of the inner edge surface of each positioning roller except the area thereof to which a corresponding cutting roller is attached, is in sliding contact with a corresponding edge surface of the roll of film so as to continuously position the cutting rollers to the film. Thus, since the free area of the inner edge surface of each positioning roller provides an actual means for positioning the cutting rollers to the film, increasing a differential diameter between the diameters of the cutting roller and positioning roller increases the positioning accuracy of the cutting rollers to the side margins of the film. On the other hand, excessively increasing the differential diameter brings the outer cylindrical surface of the positioning roller into contact with a rotatable shaft on which the roll core is mounted as the diameter of the roll of film becomes reduced, which blocks the roll of film from rotation and leaves turn of the roll of film which cannot be provided with microcuts.

The shaft has the pairs of the cutting rollers and positioning rollers mounted accurately at predetermined positions on the shaft and receiving a force sufficient to produce a pressure forming the microcuts in the outermost turn of the roll of film. A means for applying this force to the cutting rollers will not be particularly restricted but may be a weight hanging on the pair of positioning rollers or a load placed on the pair of positioning rollers.

Thus, the shaft with the pairs of positioning rollers and cutting rollers mounted thereon descends as the film is fed from the roll of film and the diameter of the roll of film concurrently decreases. In order to smoothly rotate and descend the shaft, the shaft support plate preferably has a means for following the descent of the shaft, e.g., a vertical slot, etc.

The present invention was made from the discovery that the hardnesses of an outer cylindrical surface of the roll of film and the outer cylindrical surface of the roll core made of paper essentially equal a hardness required for a roller mating or receiving the cutting roller. Since the free areas of the inner edge surfaces of the pair of positioning rollers are in close contact with the edge surfaces of the roll of film so as to position the pair of cutting rollers to be in close contact with the top surfaces of the side margins of the film under a force of a predetermined magnitude, the cutting rollers rotate under this force, following a rotation of the roll of film rotating when the film is fed from the roll of film, so that the edged projections of the cutting rollers can form the microcuts in the opposite side margins of the film. That is, the roll of film serves as a conventional receiving roller for the cutting rollers so as to eliminate a need for the addition of receiving rollers for the cutting roller.

In addition, the cutting rollers and positioning rollers follow in unit the roll of film which may otherwise transversely rock, so as to nullify the adverse effect of rocking of the film, thereby continuously securing an accurate positioning of the cutting rollers to the opposite side margins of the film.

DESCRIPTION OF THE PREFERRED EMBODIMENTS

Figure 1:
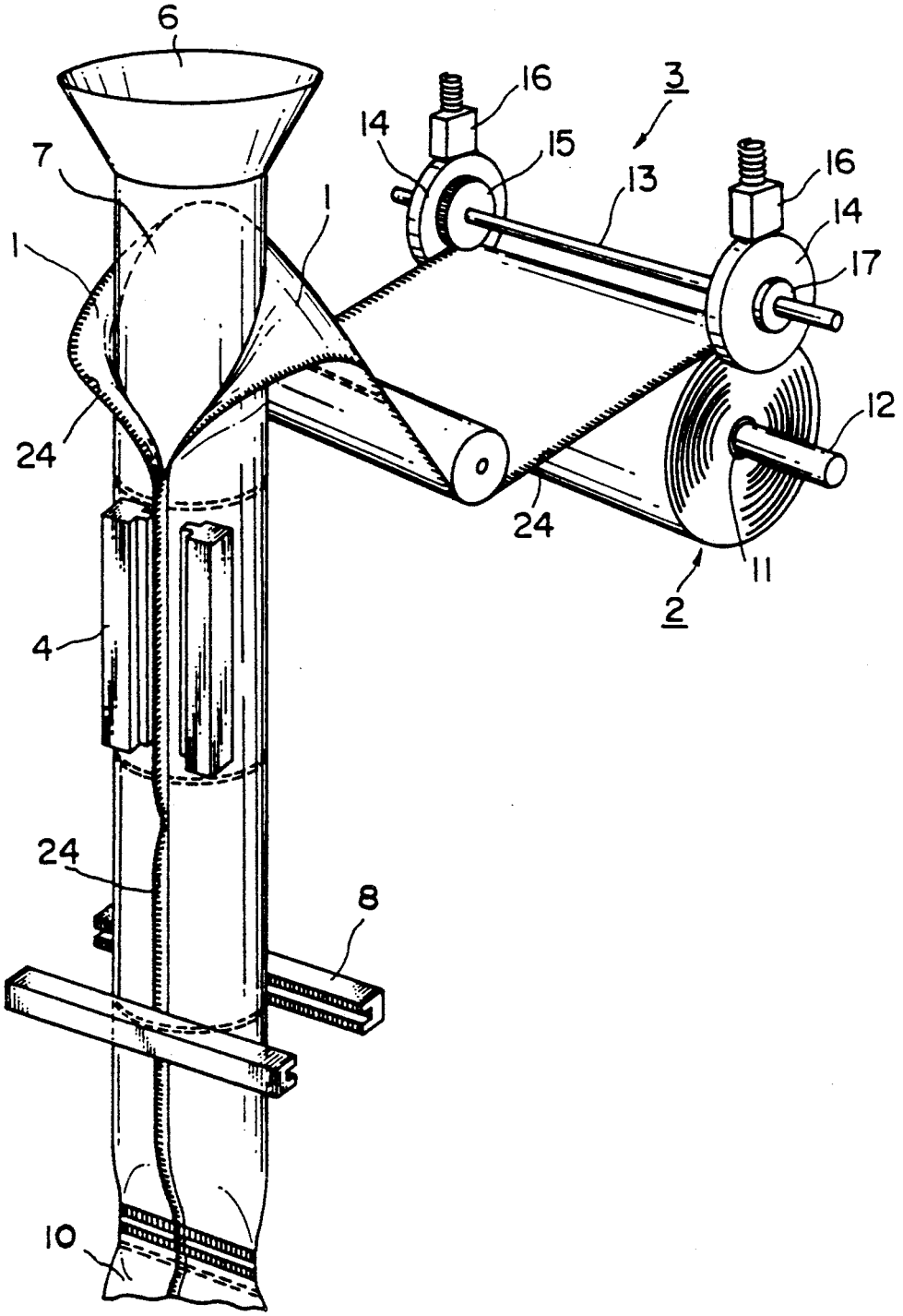
FIG. 1 is a perspective view of an automatic bag-making packer as an embodiment of the present invention.

The preferred embodiments of the present invention will now be described with reference to FIGS. 1-5. FIG. 1 is a perspective view of an automatic bag-making packer with an easy-opening processing unit assembled therein. A plastic film is indicated at 1. A film feeder feeding a film from a roll of film is indicated at 2. The film feeder has an easy-opening processing unit 3 mounted to the film feeder 2. A hopper releasing a predetermined amount of contents into a bag with the bottom heat sealed, is indicated at 6. A hollow cylindrical sailor with a top receiving the hopper 6 is indicated at 7. The outer cylindrical surface of the sailor 7 receives the film 2 wound thereon so as to shape the film 2 in a corresponding cylindrical or tubular form. An axial heat sealer is indicated at 4 and heat seals the superposed opposite side margins of the film 2 which has been shaped in cylindrical form by the sailor 7. A transverse heat sealer and separator unit is indicated at 8, which heat seals tubular film 2 transversely thereof to concurrently provide a sealed top margin of a preceding bag and a sealed bottom margin of a next bag and concurrently separates the preceding and next bags at the center between the sealed top margin of the preceding bag and the sealed bottom margin of the next bag. The transverse heat sealer and separator unit 8 may separate the preceding and next bags immediately after completion of a transverse heat sealing operation thereof. The hopper 6 releases the contents into the next bag between the completion of a preceding transverse heat sealing stroke and the beginning of a next transverse heat sealing stroke. Thus, the automatic bag-making packer sequentially produces sealed and packed bags 10. FIG. 1 illustrates pairs of transverse dash lines on the film 2. The spacing between adjacent pairs of transverse dash lines represents a length of each sealed and packed bag 10 to be produced.

Figure 2:
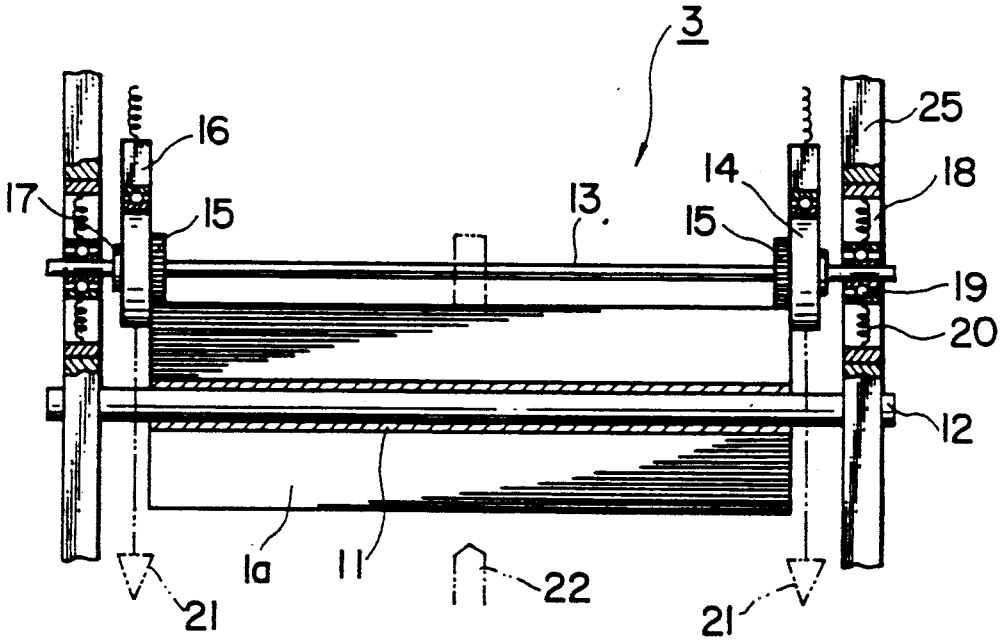
FIG. 2 is a sectional view of an easy-opening processing unit assembled in the automatic bag-making packer of FIG. 1.

FIG. 2 is a sectional view of an easy-opening processing unit assembled in the automatic bag-making packer of FIG. 1. A hollow cylindrical roll core made of paper is indicated at 11. A roll of film mounted on the roll core 11 is indicated at 1*a*. A fixed shaft passing through the roll core 11 is indicated at 12 so that the roll core 11 is rotatable about the fixed shaft 12. A rotatable shaft extending in parallel to the roll core 11 is indicated at 13. Support plates 25 support the opposite ends of the rotatable shaft 13 by means of bearings 19. The rotatable shaft 13 has a pair of positioning rollers 14 fixedly mounted thereon with a spacing between the positioning rollers 14 equalling the breadth of the film 2.

A pair of working or cutting rollers are indicated at 15. Each of the cutting rollers 15 has a diameter smaller than that of a corresponding one of the positioning rollers and is mounted to the rotatable shaft 13 so that the outer edge surface of that cutting roller 15 is closely attached to the inner edge surface of a corresponding positioning roller 14 and so that the cutting rollers 15 are coaxial with the positioning rollers 14. A pusher is indicated at 16 and continuously pushes the positioning rollers 14 by means of bearings. A pair of retainers is indicated at 17 and fixes the positioning rollers 14 and cutting rollers 15 to the rotatable shaft 13. Since bags to be produced have various sizes, rolls of films have various breadths. Therefore, mount positions of the positioning rollers 14 and cutting rollers 15 can be adjusted to the breadths of the rolls of film 1*a*. A pair of vertical slots are indicated at 18 and defined in the opposite support plates 25. The bearings 19 are float-supported on the support plates 25 in the vertical slots 18 between springs 20 mounted on the top and bottom edges of the vertical slots 18. Since the force of lower springs 20 is smaller than the total of the weight of the unit of the shaft 13, positioning rollers 14 and cutting rollers 15 and the force from the pusher 16, this unit descends following a reduction in the diameter of the roll of film 1*a* so that a free area of the inner edge surface of each of the positioning rollers 14 except an area thereof to which each of the cutting rollers 15 is attached is continuously in close contact with a corresponding edge surface of the roll of film 1*a* and so that the cutting outer cylindrical surface of each of the cutting rollers 15 is continuously in close contact with the opposite side margins of an outermost turn of the roll of film 1*a*.

Figure 3:
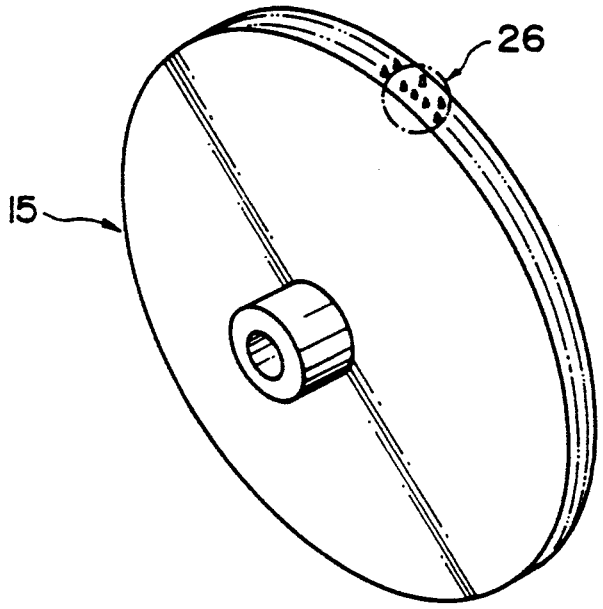
FIG. 3 is a perspective view of a cutting roller.
Figure 4:
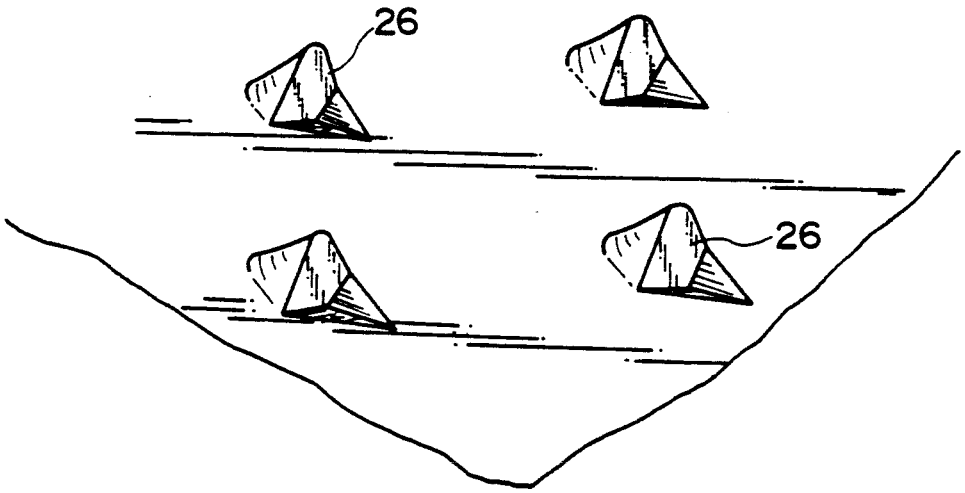
FIG. 4 is an enlarged plan view of the encircled portion IV in FIG. 3.

As shown in FIG. 3, the outer cylindrical surface of each of the cutting rollers 15 has a large number of edged projections which are arranged along the outer cylindrical surface thereof and can provide microcuts in the opposite side margins of the outermost turn of the roll of film 1*a*. In particular, the outer cylindrical surface of the cutting roller 15 has essentially the same cutting hard microridges 26 as those of a file so as to form microcuts in the opposite side margins of the film 1 closely to one another. In addition, each cutting projection of the cutting roller 15 may be in pyramidal form, as shown in FIG. 4. In addition, the cutting roller 15 may be made of mild steel, an edged instrument may cut into the outer cylindrical surface of the cutting roller 15 and erect cut portions of the outer cylindrical surface thereof to provide blank-edged projections, and then the cutting roller 15 may be quenched to provide complete edged projections which can form the microcuts.

Alternatively, a weight 21 illustrated in phantom lines in FIG. 2 may replace the pusher 16 to provide a following force to the unit of shaft 13, positioning rollers 14 and cutting rollers 15. Alternatively, a spring or weight may produce the force of the pusher 16.

Alternatively, the center of the shaft 13 may have an additional cutting roller as illustrated in phantom lines in FIG. 2 when two streams of film concurrently provide sealed and packed bags. In this case, a separator 22 illustrated in phantom lines in FIG. 2 separates a film fed from a roll of film at the axial center of a central margin of the film having microcuts formed by the additional cutter.

Figure 5:
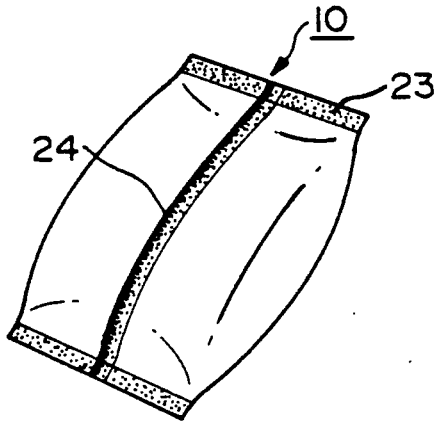
FIG. 5 is a perspective view of a complete sealed and packed bag.

FIG. 5 illustrates a complete sealed and packed bag 10 having axial and transverse heat sealed margins 23 and microcuts 24 defined in the axial heat sealed margin 23 in accordance with the process of the present invention. The microcuts 24 are difficult to identify with the naked eye and cannot pass through the axial heat sealed margin 23 of the bag 10 made with superposed opposite side margins of the original film 1.

What is claimed is:

1. In a process for producing a sealed and packed bag by means of an automatic bag-making packer, a process for providing easy-opening of the sealed and packed bag comprising pressing on each outermost side margin of an outermost turn of a roll of film a cylindrical surface of a respective one of a pair of cutting rollers of the automatic bag-making packer, the cylindrical surface of each said cutting roller having multiple edged projections, to form microcuts in said outermost side margins with said edged projections so that a subsequently packed and heat-sealed bag is easily opened from heat-sealed outermost side margins of the sealed and packed bag having said microcuts therein without reducing mechanical strength of a film consituting the sealed and packed bag, and positioning an inner side surface of each of a pair of positioning rollers against respective side surfaces of said roll of film, including said outermost turn, and against respective outer side surfaces of said cutting rollers to prevent transverse movement of said roll of film during said pressing.

2. A process as recited in claim 1, wherein at least one of the edged projections has a truncate surface normal to a radius of the cutting roller passing through the one edged projection.

3. A process as recited in claim 2, wherein the cutting roller comprises quenched steel.

4. A process as recited in claim 1, wherein said film is a single-layer film selected from the group consisting of polyethylene, polypropylene, polyester and nylon.

5. A process as recited in claim 1, wherein said film is a multilayer film comprising at least first and second layers, said first and second layers being different and each layer being selected from the group consisting of polyethylene, polypropylene, polyester and nylon.

6. A process as recited in claim 5, wherein said multilayer film further comprises a third layer selected from the group consisting of aluminum foil and polyvinylidene chloride.

7. A process as recited in claim 1, wherein said film is a multilayer laminated film comprising at least two layers including a first inner layer of heat-sealable material and a second layer of a non-heat-sealable material.

8. A process as recited in claim 7 wherein said heat-sealable material is selected from the group consisting of low density polyethylene and ethylene-vinyl-acetate copolymer and said non-heat-sealable material is selected from the group consisting of polyester and nylon.

9. A process as recited in claim 8, wherein said multilayer film further comprises a third layer selected from the group consisting of aluminum foil and polyvinylidene chloride.

10. A process as recited in claim 8, wherein at least one of the edged projections has a truncate surface normal to a radius of the cutting roller passing through the one edged projection.

11. A process as recited in claim 1, wherein said microcuts are formed closely together and are dimensioned so as to be difficult to identify with the naked eye.

12. A process as recited in claim 1, wherein said cutting roller and said positioning roller are mounted on a common shaft.

13. A process as recited in claim 12, wherein said pressing is accomplished by pressing means directly pushing on said cutting rollers.

14. A process as recited in claim 12, wherein said pressing is accomplished by pressing means directly pushing on said positioning rollers.

15. An automatic bag-making packer using a film for bag-making fed from a roll of film mounted on a hollow cylindrical roll core, the automatic bag-making packer comprising a cutting means including a pair of cutting rollers, each cutting roller comprising an outer side surface and an outer cylindrical surface, said outer cylindrical surface having edged projections thereon, said cutting means being arranged in close contact with opposite side edges of an outermost turn of the roll of film, the cutting rollers being adapted to rotate and press said edged projections onto the opposite side edges of the outermost turn of the roll of film as the film is fed from the roll of film to form microcuts therein, and a pair of positioning rollers, each positioning roller having a first inner side surface portion attached to the outer side surface of a corresponding cutting roller, so that the cutting rollers and positioning rollers are fixedly mounted coaxially with one another, each of the positioning rollers further having a diameter larger than a diameter of a corresponding cutting roller, said positioning roller thereby having a second inner side surface portion in close contact with a corresponding side surface of the roll of film so as to arrange the outer cylindrical surfaces of the cutting rollers in close contact with the opposite side edges of the outermost turn of the roll of film and prevent transverse movement of said roll of film during pressing.

16. An automatic bag-making packer as recited in claim 15, wherein at least one of the edged projections has a truncate surface normal to a radius of the cutting roller passing through the one edged projection.

17. An automatic bag-making packer as recited in claim 15, further comprising a shaft having the pair of cutting rollers and positioning rollers fixedly mounted coaxially thereon.

18. An automatic bag-making packer as recited in claim 15, further comprising a means for pushing the cutting rollers to form the microcuts in the outermost turn of the roll of film.

19. An automatic bag-making packer as recited in claim 18, wherein the pushing means directly pushes the positioning rollers attached to said cutting rollers so that the cutting rollers form the microcuts.

20. An automatic bag-making packer as recited in claim 18, wherein said positioning rollers and said cutting rollers are fixedly mounted coaxially on a shaft, and pushing means comprises a means for producing a radial force directly on the shaft so that the cutting rollers form the microcuts.

* * * * *